US008037949B2

(12) United States Patent
Juhasz et al.

(10) Patent No.: US 8,037,949 B2
(45) **Date of Patent: *Oct. 18, 2011**

(54) PIPE RUNNING TOOL

(75) Inventors: Daniel Juhasz, Westminster, CA (US); George Boyadjieff, Villa Park, CA (US); Brian L. Eidem, Cerritos, CA (US); Hans van Rijzingen, Etten-Leur (NL); Herman M. Kamphorst, Assen (NL); Hans Joachim Dietrich Böttger, Den Helder (NL); Gustaaf Louis van Wechem, Reeuwijk (NL)

(73) Assignee: Varco I/P, Inc., Orange, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/762,198

(22) Filed: Apr. 16, 2010

(65) Prior Publication Data

US 2010/0200215 A1 Aug. 12, 2010

Related U.S. Application Data

(63) Continuation of application No. 11/165,661, filed on Jun. 24, 2005, now Pat. No. 7,699,121, which is a continuation-in-part of application No. 11/040,453, filed on Jan. 20, 2005, now Pat. No. 7,096,977, which is a continuation of application No. 10/189,355, filed on Jul. 3, 2002, now Pat. No. 6,938,709, which is a continuation of application No. 09/518,122, filed on Mar. 3, 2000, now Pat. No. 6,443,241.

(60) Provisional application No. 60/122,915, filed on Mar. 5, 1999.

(51) Int. Cl.
*E21B 19/22* (2006.01)

(52) U.S. Cl. ..... 175/52; 166/77.51; 175/85

(58) Field of Classification Search ..... 175/52, 175/85, 162; 166/77.51, 77.52, 77.53, 85.1
See application file for complete search history.

(56) References Cited

U.S. PATENT DOCUMENTS 2,488,107 A 11/1949 Abegg
(Continued)

FOREIGN PATENT DOCUMENTS

EP 0285385 A2 10/1988
(Continued)

OTHER PUBLICATIONS

Response to Opposition against European Patent No. EP 1,171,683; Reply Document filed in EPO; Jan. 20, 2009; European Patent Office; Europe.

(Continued)

*Primary Examiner* — William P Neuder
(74) *Attorney, Agent, or Firm* — Christie, Parker & Hale, LLP

(57) ABSTRACT

A pipe running tool for use in an oil drilling system and the like comprises a lower drive shaft adapted to engage a drive shaft of a top drive assembly for rotation therewith. The pipe running tool further includes a lower pipe engagement assembly which is driven to rotate by the lower drive shaft, and is designed to releasably engage a pipe segment in such a manner to substantially prevent relative rotation between the two. Thus, when the lower pipe engagement assembly is actuated to securely hold a pipe segment, the top drive assembly may be actuated to rotate the top drive output shaft, which causes the lower drive shaft and lower pipe engagement assembly to rotate, which in turn rotates the pipe segment.

23 Claims, 4 Drawing Sheets

U.S. PATENT DOCUMENTS

| | | | | |
|---|---|---|---|---|
| 2,863,638 | A | 12/1958 | Thornburg | |
| 3,193,116 | A | 7/1965 | Kenneday et al. | |
| 3,301,334 | A | 1/1967 | Odgers et al. | |
| 3,706,347 | A | 12/1972 | Brown | |
| 3,708,020 | A | 1/1973 | Adamson | |
| 3,747,675 | A | 7/1973 | Brown | |
| 3,766,991 | A | 10/1973 | Brown | |
| 3,780,883 | A | 12/1973 | Brown | |
| 3,915,244 | A | 10/1975 | Brown | |
| 4,100,968 | A | 7/1978 | Delano | |
| 4,190,119 | A | 2/1980 | Loftis et al. | |
| 4,274,778 | A | 6/1981 | Putnam et al. | |
| 4,403,897 | A | 9/1983 | Willis | |
| 4,449,596 | A | 5/1984 | Boyadjieff | |
| 4,529,045 | A | 7/1985 | Boyadjieff et al. | |
| 4,535,852 | A | 8/1985 | Boyadjieff et al. | |
| 4,570,706 | A | 2/1986 | Pugnet | |
| 4,593,773 | A | 6/1986 | Skeie | |
| 4,605,077 | A | 8/1986 | Boyadjieff | |
| 4,709,766 | A | 12/1987 | Boyadjieff | |
| 4,715,451 | A | 12/1987 | Bseisu et al. | |
| 4,781,359 | A | 11/1988 | Matus | |
| 4,791,997 | A | 12/1988 | Krasnov | |
| 4,997,042 | A | 3/1991 | Jordan et al. | |
| 5,036,927 | A | 8/1991 | Willis | |
| 5,107,940 | A | 4/1992 | Berry | |
| 5,191,939 | A | 3/1993 | Stokley | |
| 5,255,751 | A | 10/1993 | Stogner | |
| 5,294,228 | A | 3/1994 | Willis et al. | |
| 5,297,833 | A | 3/1994 | Willis et al. | |
| 5,351,767 | A | 10/1994 | Stogner et al. | |
| 5,584,343 | A | 12/1996 | Coone | |
| 5,735,348 | A | 4/1998 | Hawkins, III | |
| 5,785,132 | A | 7/1998 | Richardson et al. | |
| 5,839,330 | A | 11/1998 | Stokka | |
| 5,918,673 | A | 7/1999 | Hawkins et al. | |
| 5,971,079 | A | 10/1999 | Mullins | |
| 6,068,066 | A | 5/2000 | Byrt et al. | |
| 6,142,545 | A | 11/2000 | Penman et al. | |
| 6,276,450 | B1 | 8/2001 | Seneviratne | |
| 6,279,654 | B1 | 8/2001 | Mosing et al. | |
| 6,431,626 | B1 | 8/2002 | Bouligny | |
| 6,443,241 | B1 | 9/2002 | Juhasz et al. | |
| 6,527,493 | B1 | 3/2003 | Kamphorst et al. | |
| 6,799,638 | B2 | 10/2004 | Butterfield, Jr. | |
| 6,938,709 | B2 | 9/2005 | Juhasz et al. | |
| 7,059,427 | B2 | 6/2006 | Power et al. | |
| 7,699,121 | B2 * | 4/2010 | Juhasz et al. | 175/52 |
| 7,753,138 | B2 * | 7/2010 | Juhasz et al. | 175/52 |
| 2002/0170720 | A1 | 11/2002 | Haugen | |
| 2003/0066654 | A1 | 4/2003 | Juhasz et al. | |
| 2006/0005962 | A1 | 1/2006 | Juhasz et al. | |
| 2007/0074876 | A1 | 4/2007 | Pietras | |

FOREIGN PATENT DOCUMENTS

| | | | |
|---|---|---|---|
| EP | 0311455 | A1 | 4/1989 |
| EP | 0525247 | | 2/1993 |
| EP | 1 619 349 | A2 | 1/2006 |
| EP | 1171683 | B1 | 9/2007 |
| WO | WO 92/11486 | | 7/1992 |
| WO | WO 93/07358 | | 4/1993 |
| WO | WO 96/18799 | | 6/1996 |
| WO | WO 98/11322 | | 3/1998 |
| WO | WO 99/30000 | | 6/1999 |
| WO | WO 00/52297 | | 9/2000 |
| WO | WO 03/038229 | A2 | 5/2003 |

OTHER PUBLICATIONS

Complaint in CV05-0634A; Pleading; Apr. 11, 2005; 8pp.; W. Dist. Louisiana.

Plaintiff's First Amended Complaint in CV05-0634A; Pleading; Oct. 3, 2005; 7pp.; W. Dist. Louisiana; Alexandria, Louisiana.

Order Granting Motion to Transfer in CV05-0634A; Order; Jul. 19, 2006; 2pp.; W. Dist. Louisiana; Alexandria, Louisiana.

Complaint in H-05-2118; Pleading; Jun. 17, 2005; 7pp.; S. Dist. Texas; Houston, Texas.

First Amended Complaint in CV-05-2118; Pleading; Jun. 23, 2005; 6pp.; S. Dist. Texas; Houston, Texas.

Second Amended Complaint in CV-05-2118; Pleading; Sep. 6, 2005; 6pp.; S. Dist. Texas; Houston, Texas.

Stipulated Protective Order in CV-05-2118; Order; Dec. 5, 2005; 12pp.; S. Dist. Texas; Houston, Texas.

Notice of Opposition in EP 1,171,683 B1; Opposition Document filed in EPO; Apr. 1, 2008; 162pp.; European Patent Office; Europe.

Request for Inter Partes Reexamination of USPN 6,938,709; Reexamination Request filed in USPTO; Oct. 4, 2006; 115pp.; United States Patent and Trademark Office; Alexandria, Virginia.

Request for Inter Partes Reexamination of USPN 7,096,977; Reexamination Request filed in USPTO; Sep. 21, 2006; 123pp.; United States Patent and Trademark Office; Alexandria, Virginia.

International Search Report for corresponding International Application No. PCT/US06/22438 dated Sep. 25, 2007, 3pp.

Written Opinion for corresponding International Application No. PCT/US06/22438 dated Sep. 25, 2007, 3pp.

International Search Report relating to corresponding parent International Application No. PCT/US00/05752 dated Sep. 28, 2000.

Kamphorst et al., Casing Running Tool; SPE/IADC 52770; pp. 1-9.

* cited by examiner

PIPE RUNNING TOOL

CROSS-REFERENCE TO RELATED APPLICATION(S)

This application is a continuation of U.S. patent application Ser. No. 11/165,661, filed on Jun. 24, 2005, issuing as U.S. Pat. No. 7,699,121, which is a continuation-in-part of U.S. patent application Ser. No. 11/040,453, filed on Jan. 20, 2005, issued as U.S. Pat. No. 7,096,977, which is a continuation of U.S. patent application Ser. No. 10/189,355, filed on Jul. 3, 2002, issued as U.S. Pat. No. 6,938,709, which is a continuation of U.S. patent application Ser. No. 09/518,122, filed Mar. 3, 2000, issued as U.S. Pat. No. 6,443,241, which claims priority under 35 U.S.C. §119(e) to U.S. Provisional Patent Application No. 60/122,915, filed on Mar. 5, 1999.

BACKGROUND OF THE INVENTION

1. Field of the Invention

This invention relates to well drilling operations and, more particularly, to a device for assisting in the assembly of pipe strings, such as casing strings, drill strings and the like.

2. Description of the Related Art

The drilling of oil wells involves assembling drill strings and casing strings, each of which comprises a plurality of elongated, heavy pipe segments extending downwardly from an oil drilling rig into a hole. The drill string consists of a number of sections of pipe which are threadedly engaged together, with the lowest segment (i.e., the one extending the furthest into the hole) carrying a drill bit at its lower end. Typically, the casing string is provided around the drill string to line the well bore after drilling the hole and to ensure the integrity of the hole. The casing string also consists of a plurality of pipe segments which are threadedly coupled together and formed with through passages sized to receive the drill string and/or other pipe strings.

The conventional manner in which plural casing segments are coupled together to form a casing string is a labor-intensive method involving the use of a "stabber" and casing tongs. The stabber is manually controlled to insert a segment of casing into the upper end of the existing casing string, and the tongs are designed to engage and rotate the segment to threadedly connect it to the casing string. While such a method is effective, it is cumbersome and relatively inefficient because the procedure is done manually. In addition, the casing tongs require a casing crew to properly engage the segment of casing and to couple the segment to the casing string. Thus, such a method is relatively labor-intensive and therefore costly. Furthermore, using casing tongs requires the setting up of scaffolding or other like structures, and is therefore inefficient.

Accordingly, it will be apparent to those skilled in the art that there continues to be a need for a device for use in a drilling system which utilizes an existing top drive assembly to efficiently assemble casing and/or drill strings, and which positively engages a pipe segment to ensure proper coupling of the pipe segment to a pipe string. The present invention addresses these needs and others.

SUMMARY OF THE INVENTION

Briefly, and in general terms, the present invention is directed to a pipe running tool for use in drilling systems and the like to assemble casing and/or drill strings. The pipe running tool is coupled to an existing top drive assembly which is used to rotate a drill string, and includes a powered elevator that is powered into an engaged position to securely engage a pipe segment, for example, a casing segment. Because the elevator is powered into the engaged position, the pipe segment may be properly coupled to an existing pipe string using the top drive assembly.

The system of the present invention in one illustrative embodiment is directed to a pipe running tool mountable on a rig and including: a top drive assembly adapted to be connected to the rig for vertical displacement of the top drive assembly relative to the rig, the top drive assembly including a drive shaft, the top drive assembly being operative to rotate the drive shaft; and a lower pipe engagement assembly including a central passageway sized for receipt of the pipe segment, the lower pipe engagement assembly including a powered engagement device that is powered to an engaged position to securely and releasably grasp the pipe segment, the lower pipe engagement assembly being in communication with the drive shaft, whereby actuation of the top drive assembly causes the lower pipe engagement assembly to rotate.

In another illustrative embodiment, the present invention is directed to a method of assembling a pipe string, including the steps of: actuating a lower pipe engagement assembly to releasably engage a pipe segment; lowering a top drive assembly to bring the pipe segment into contact with a pipe string; monitoring the load on the pipe string; actuating a load compensator to raise the pipe segment a selected distance relative to the pipe string, if the load on the pipe string exceeds a predetermined threshold value; and actuating the top drive assembly to rotate the pipe segment to threadedly engage the pipe segment and pipe string.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENTS

Figure 1:
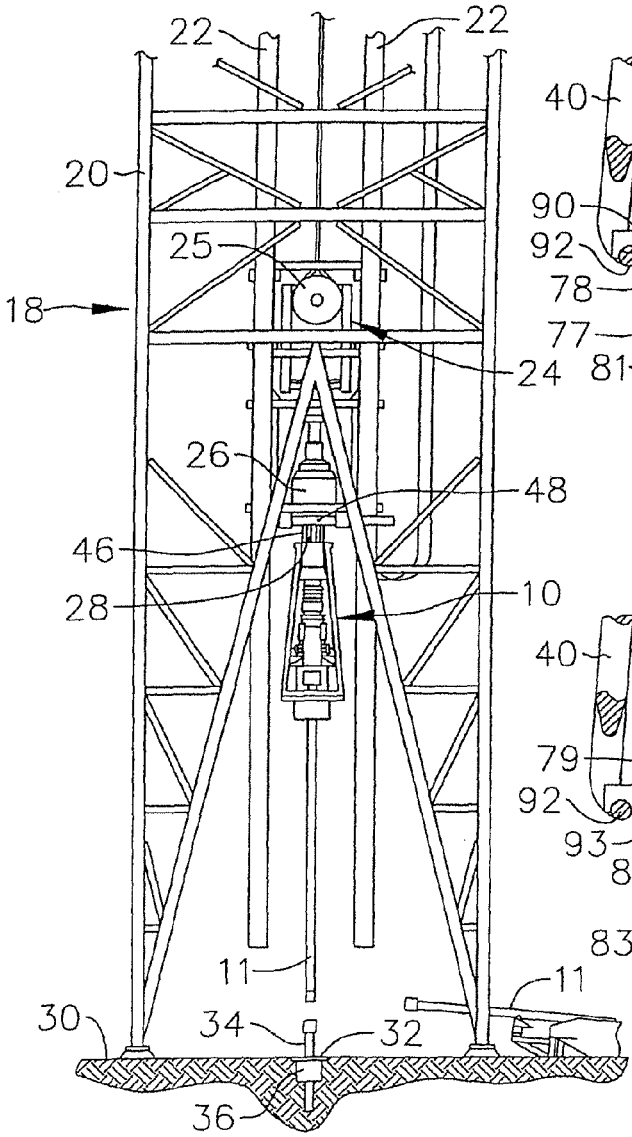
FIG. 1 is an elevated side view of a drilling rig incorporating a pipe running tool according to one illustrative embodiment of the present invention.
Figure 2:
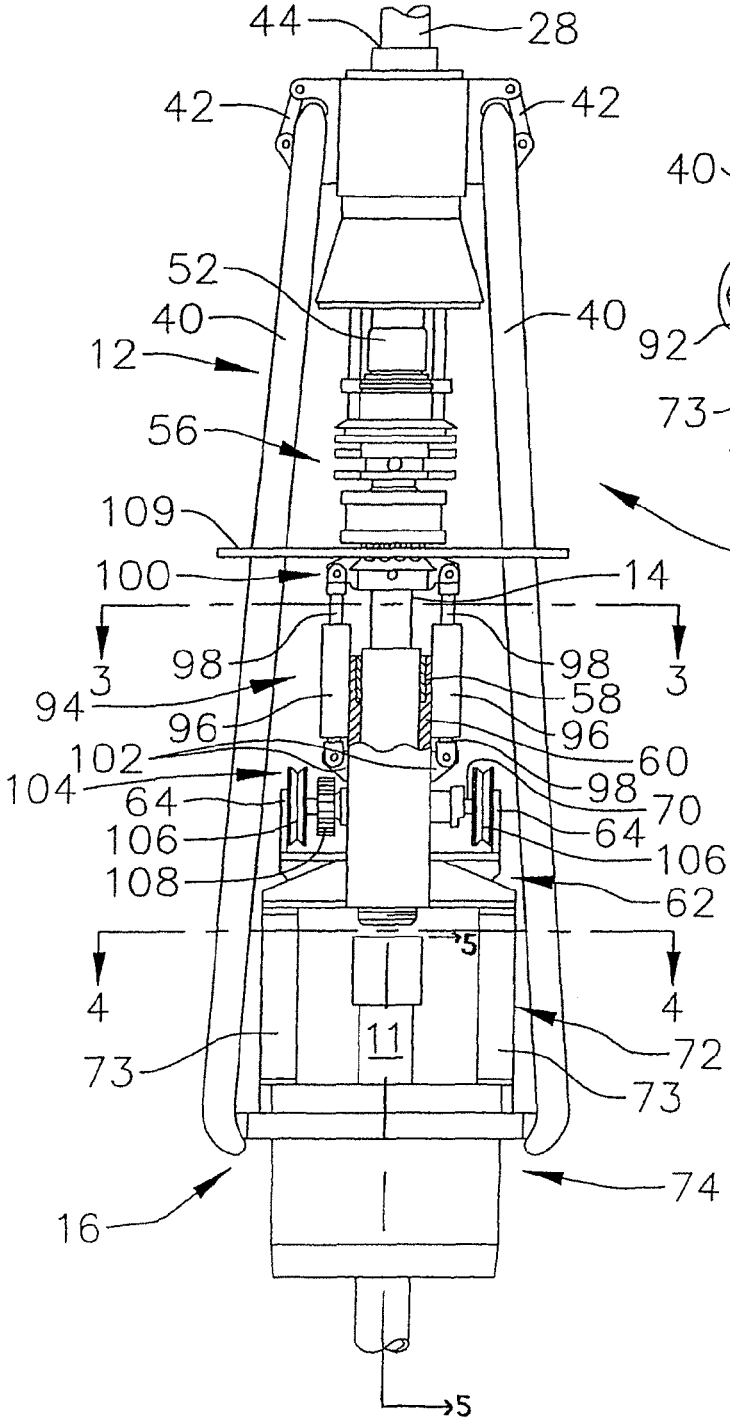
FIG. 2 is a side view, in enlarged scale, of the pipe running tool of FIG. 1.
Figure 4:
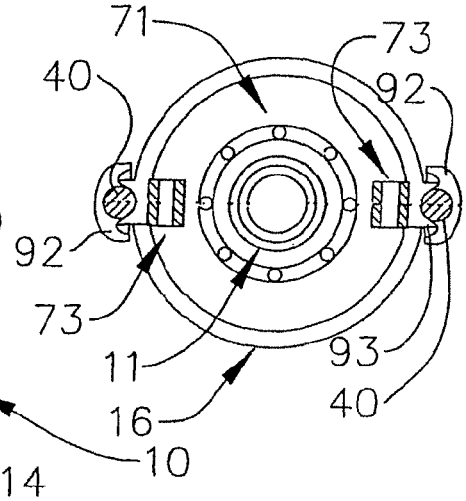
FIG. 4 is a cross-sectional view taken along the line 4-4 of FIG. 2.
Figure 3:
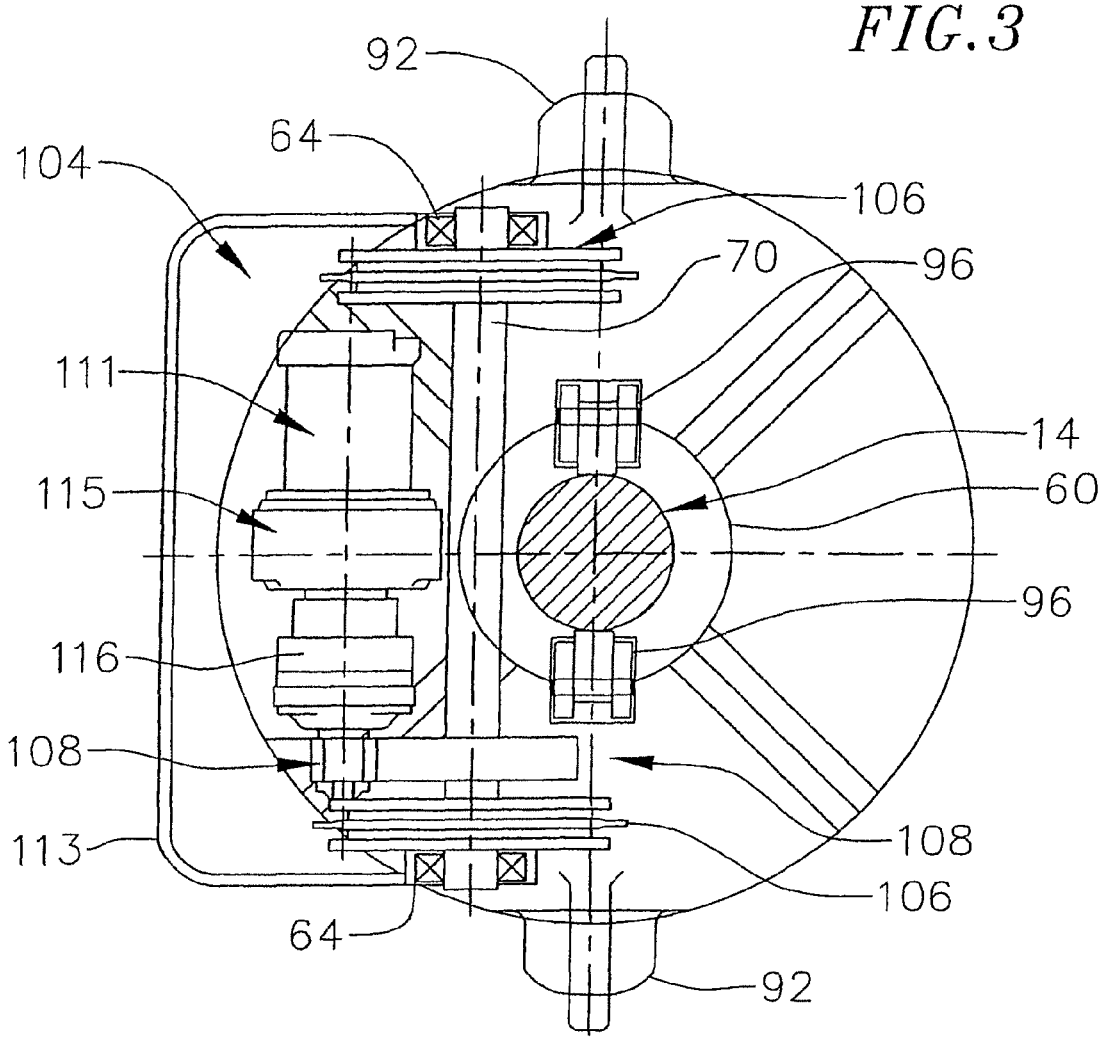
FIG. 3 is a cross-sectional view taken along the line 3-3 of FIG. 2.

In the following detailed description, like reference numerals will be used to refer to like or corresponding elements in the different figures of the drawings. Referring now to FIGS. 1 and 2, there is shown a pipe running tool 10 depicting one illustrative embodiment of the present invention, which is designed for use in assembling pipe strings, such as drill strings, casing strings, and the like. As shown for example in FIG. 2, the pipe running tool 10 comprises, generally, a frame assembly 12, a rotatable shaft 14, and a lower pipe engagement assembly 16 that is coupled to the rotatable shaft 14 for rotation therewith. The pipe engagement assembly 16 is designed for selective engagement of a pipe segment 11 (as shown for example in FIGS. 1, 2, and 5A) to substantially prevent relative rotation between the pipe segment 11 and the pipe engagement assembly 16. As shown for example in FIG. 1, the rotatable shaft 14 is designed for coupling with a top drive output shaft 28 from an existing top drive 24, such that the top drive 24, which is normally used to rotate a drill string to drill a well hole, may be used to assemble a pipe string, for example, a casing string or a drill string, as is described in greater detail below.

As show, for example, in FIG. 1, the pipe running tool 10 is designed for use, for example, in a well drilling rig 18. A suitable example of such a rig is disclosed in U.S. Pat. No. 4,765,401 to Boyadjieff, which is expressly incorporated herein by reference as if fully set forth herein. As shown in FIG. 1, the well drilling rig 18 includes a frame 20 and a pair of guide rails 22 along which a top drive assembly, generally designated 24, may ride for vertical movement relative to the well drilling rig 18. The top drive assembly 24 is preferably a conventional top drive used to rotate a drill string to drill a well hole, as is described in U.S. Pat. No. 4,605,077 to Boyadjieff, which is expressly incorporated herein by reference. The top drive assembly 24 includes a drive motor 26 and a top drive output shaft 28 extending downwardly from the drive motor 26, with the drive motor 26 being operative to rotate the drive shaft 28, as is conventional in the art. The well drilling rig 18 defines a drill floor 30 having a central opening 32 through which a drill string and/or casing string 34 is extended downwardly into a well hole.

The rig 18 also includes a flush-mounted spider 36 that is configured to releasably engage the drill string and/or casing string 34 and support the weight thereof as it extends downwardly from the spider 36 into the well hole. As is well known in the art, the spider 36 includes a generally cylindrical housing which defines a central passageway through which the pipe string 34 may pass. The spider 36 includes a plurality of slips which are located within the housing and are selectively displaceable between disengaged and engaged positions, with the slips being driven radially inwardly to the respective engaged positions to tightly engage the pipe segment and thereby prevent relative movement or rotation of the pipe segment and the spider housing. The slips are preferably driven between the disengaged and engaged positions by means of a hydraulic or pneumatic system, but may be driven by any other suitable means.

Referring primarily to FIG. 2, the pipe running tool 10 includes the frame assembly 12, which comprises a pair of links 40 extending downwardly from a link adapter 42. The link adapter 42 defines a central opening 44 through which the top drive output shaft 28 may pass. Mounted to the link adapter 42 on diametrically opposed sides of the central opening 44 are respective upwardly extending, tubular members 46 (FIG. 1), which are spaced a predetermined distance apart to allow the top drive output shaft 28 to pass therebetween. The respective tubular members 46 connect at their upper ends to a rotating head 48, which is connected to the top drive assembly 24 for movement therewith. The rotating head 48 defines a central opening (not shown) through which the top drive output shaft 28 may pass, and also includes a bearing (not shown) which engages the upper ends of the tubular members 46 and permits the tubular members 46 to rotate relative to the rotating head body, as is described in greater detail below.

The top drive output shaft 28 terminates at its lower end in an internally splined coupler 52 which is engaged to an upper end (not shown) of the lower drive shaft 14 which is formed to complement the splined coupler 52 for rotation therewith. Thus, when the top drive output shaft 28 is rotated by the top drive motor 26, the lower drive shaft 14 of the pipe running tool 10 is also rotated. It will be understood that any suitable interface may be used to securely engage the top and lower drive shafts together.

In one illustrative embodiment, the lower drive shaft 14 of the pipe running tool 10 is connected to a conventional pipe handler, generally designated 56, which may be engaged by a suitable torque wrench (not shown) to rotate the lower drive shaft 14 and thereby make and break connections that require very high torque, as is well known in the art.

The lower drive shaft 14 of the pipe running tool is also formed with a splined segment 58, which is slidably received in an elongated, splined bushing 60 which serves as an extension of the lower drive shaft 14 of the pipe running tool 10. The drive shaft 14 and the bushing 60 are splined to provide for vertical movement of the shaft 14 relative to the bushing 60, as is described in greater detail below. It will be understood that the splined interface causes the bushing 60 to rotate when the lower drive shaft 14 of the pipe running tool 10 rotates.

The pipe running tool 10 further includes the lower pipe engagement assembly 16, which in one embodiment comprises a torque transfer sleeve 62 (as shown for example in FIG. 2), which is securely connected to a lower end of the bushing 60 for rotation therewith. The torque transfer sleeve 62 is generally annular and includes a pair of upwardly projecting arms 64 on diametrically opposed sides of the sleeve 62. The arms 64 are formed with respective horizontal through passageways (not shown) into which are mounted respective bearings (not shown) which serve to journal a rotatable axle 70 therein, as described in greater detail below. The torque transfer sleeve 62 connects at its lower end to a downwardly extending torque frame 72 in the form of a pair of tubular members 73, which in turn is coupled to a spider\elevator 74 which rotates with the torque frame 72. It will be apparent that the torque frame 72 may have any one of a variety of structures, such as a plurality of tubular members, a solid body, or any other suitable structure.

Figure 5A:
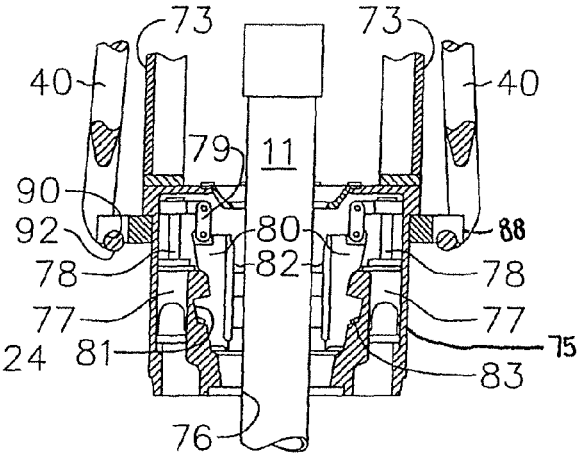
FIG. 5A is a cross-sectional view taken along the line 5-5 of FIG. 4 and showing a spider\elevator in a disengaged position.
Figure 5B:
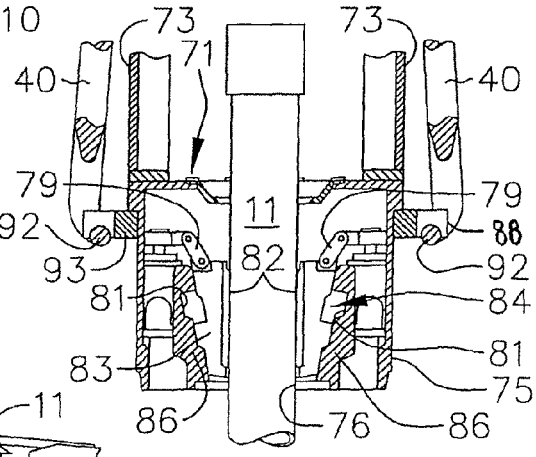
FIG. 5B is a cross-sectional view similar to FIG. 5A and showing the spider\elevator in an engaged position.

The spider\elevator 74 is preferably powered by a hydraulic or pneumatic system, or alternatively by an electric drive motor or any other suitable powered system. As shown in FIGS. 5A and 5B, the spider\elevator includes a housing 75 which defines a central passageway 76 through which the pipe segment 11 may pass. The spider\elevator 74 also includes a pair of hydraulic or pneumatic cylinders 77 with displaceable piston rods 78 (FIGS. 5A and 5B) which are connected through suitable pivotable linkages 79 to respective slips 80. The linkages 79 are pivotally connected to both the top ends of the piston rods 78 and to the top ends of the slips 80. The slips 80 include generally planar front gripping surfaces 82, and specially contoured rear surfaces 84 which are designed with such a contour to cause the slips 80 to travel between respective radially outwardly disposed, disengaged positions, and radially inwardly disposed, engaged positions. The rear surfaces of the slips 80 travel along respective downwardly and radially inwardly projecting guiding members 86 which are complementarily contoured and securely connected to the spider body. The guiding members 86 cooperate with the cylinders 77 and linkages 79 to cam the slips 80 radially inwardly and force the slips 80 into the respective engaged positions. Thus, the cylinders 77 (or other actuating means) may be empowered to drive the piston rods 78 downwardly, causing the corresponding linkages 79 to be driven downwardly and therefore force the slips 80 downwardly. The surfaces of the guiding members 86 are angled to force the slips 80 radially inwardly as they are driven downwardly to sandwich the pipe segment 11 between them, with the guiding members 86 maintaining the slips 80 in tight engagement with the pipe segment 11. To release the pipe segment 11, the cylinders 77 are operated in reverse to drive the piston rods 78 upwardly, which draws the linkages 79 upwardly and retracts the respective slips 80 back to their disengaged positions to release the pipe segment 11. The guiding members 86 are preferably formed with respective notches 81 which receive respective projecting portions 83 of the slips 80 to lock the slips 80 in the disengaged position (FIG. 5A).

The spider\elevator 74 further includes a pair of diametrically opposed, outwardly projecting ears 88 formed with downwardly facing recesses 90 sized to receive correspondingly formed, cylindrical members 92 at the bottom ends of the respective links 40, and thereby securely connect the lower ends of the links 40 to the spider\elevator 74. The ears 88 may be connected to an annular sleeve 93 which is received over the housing 75, or may be integrally formed with the housing.

In one illustrative embodiment, the pipe running tool 10 includes a load compensator, generally designated 94. In one embodiment, the load compensator 94 preferably is in the form of a pair of hydraulic, double rodded cylinders 96, each of which includes a pair of piston rods 98 that are selectively extendable from, and retractable into, the cylinders 96. Upper ends of the rods 98 connect to a compensator clamp 100, which in turn is connected to the lower drive shaft 14 of the pipe running tool 10, while lower ends of the rods 98 extend downwardly and connect to a pair of ears 102 which are securely mounted to the bushing 60. The hydraulic cylinders 96 may be actuated to draw the bushing 60 upwardly relative to the lower drive shaft 14 of the pipe running tool 10 by applying a pressure to the cylinders 96 which causes the upper ends of the piston rods 98 to retract into the respective cylinder bodies 96, with the splined interface between the bushing 60 and the lower drive shaft 14 allowing the bushing 60 to be displaced vertically relative to the shaft 14. In that manner, the pipe segment 11 carried by the spider\elevator 74 may be raised vertically to relieve a portion or all of the load applied to the pipe segment 11, as is described in greater detail below. As is shown in FIG. 2, the lower ends of the rods 98 are at least partially retracted, resulting in the majority of the load from the pipe running tool 10 is assumed by the top drive output shaft 28. In addition, when a load above a pre-selected maximum is applied to the pipe segment 11, the cylinders 96 will automatically retract the load to prevent the entire load from being applied to the threads of the pipe segment.

In one embodiment, the pipe running tool 10 still further includes a hoist mechanism, generally designated 104, for hoisting a pipe segment 11 upwardly into the spider\elevator 74. In the embodiment of FIG. 2, the hoist mechanism 104 is disposed off-axis and includes a pair of pulleys 106 carried by the axle 70, the axle 70 being journaled into the bearings in respective through passageways formed in the arms 64. The hoist mechanism 104 also includes a gear drive, generally designated 108, that may be selectively driven by a hydraulic motor 111 or other suitable drive system to rotate the axle 70 and thus the pulleys 106. The hoist may also include a brake 115 to prevent rotation of the axle 70 and therefore of the pulleys 106 and lock them in place, as well as a torque hub 116. Therefore, a pair of chains, cables, or other suitable, flexible means may be run over the respective pulleys 106, extended through a chain well 113, and engaged to the pipe segment 11, and the axle 70 is then rotated by a suitable drive system to hoist the pipe segment 11 vertically and up into position with the upper end of the pipe segment 11 extending into the spider\elevator 74.

In one embodiment, as shown in FIG. 1, the pipe running tool 10 preferably further includes an annular collar 109 which is received over the links 40 and which maintains the links 40 locked to the ears 88 and prevents the links 40 from twisting and/or winding.

In use, a work crew may manipulate the pipe running tool 10 until the upper end of the tool 10 is aligned with the lower end of the top drive output shaft 28. The pipe running tool 10 is then raised vertically until the splined coupler 52 at the lower end of the top drive output shaft 28 is engaged to the upper end of the lower drive shaft 14 of the pipe running tool 10 and the links 40 of the pipe running tool 10 are engaged with the ears 88. The work crew may then run a pair of chains or cables over the respective pulleys 106 of the hoist mechanism 104, connect the chains or cables to a pipe segment 11, engage a suitable drive system to the gear 108, and actuate the drive system to rotate the pulleys 106 and thereby hoist the pipe segment 11 upwardly until the upper end of the pipe segment 11 extends through the lower end of the spider\elevator 74. The spider\elevator 74 is then actuated, with the hydraulic cylinders 77 and guiding members 86 cooperating to forcibly drive the respective slips 80 into the engaged positions (FIG. 5B) to positively engage the pipe segment 11. The slips 80 are preferably advanced to a sufficient extent to prevent relative rotation between the pipe segment 11 and the spider\elevator 74, such that rotation of the spider\elevator 74 translates into rotation of the pipe segment 11.

The top drive assembly 24 is then lowered relative to the frame 20 by means of a top hoist 25 to drive the threaded lower end of the pipe segment 11 into contact with the threaded upper end of the pipe string 34 (FIG. 1). As shown in FIG. 1, the pipe string 34 is securely held in place by means of the flush-mounted spider 36 or any other suitable structure for securing the string 34 in place, as is well known to those skilled in the art. Once the threads of the pipe segment 11 are properly mated with the threads of the pipe string 34, the top drive motor 26 is then actuated to rotate the top drive output shaft 28, which in turn rotates the lower drive shaft 14 of the pipe running tool 10 and the spider\elevator 74, which causes the coupled pipe segment 11 to rotate and thereby be threadedly engaged to the pipe string 34.

In one embodiment, the pipe segment 11 is intentionally lowered until the lower end of the pipe segment 11 rests on the top of the pipe string 34. The load compensator 94 is then actuated to drive the bushing 60 upwardly relative to the lower drive shaft 14 of the pipe running tool 10 via the splined interface between the two. The upward movement of the bushing 60 causes the spider\elevator 74 and therefore the coupled pipe segment 11 to be raised, thereby reducing the weight on the threads of the pipe segment. In this manner, the load on the threads can be controlled by actuating the load compensator 94.

Once the pipe segment 11 is threadedly coupled to the pipe string 34, the top drive assembly 24 is raised vertically to lift the entire pipe string 34, which causes the flush-mounted spider 36 to disengage the pipe string 34. The top drive assembly 24 is then lowered to advance the pipe string 34 downwardly into the well hole until the upper end of the top pipe segment 11 is close to the drill floor 30, with the entire load of the pipe string being carried by the links 40 while the torque was supplied through shafts. The flush-mounted spider 36 is then actuated to engage the pipe string 11 and suspend it therefrom. The spider\elevator 74 is then controlled in reverse to retract the slips 80 back to the respective disengaged positions (FIG. 5A) to release the pipe string 11. The top drive assembly 24 is then raised to lift the pipe running tool 10 up to a starting position (such as that shown in FIG. 1) and the process may be repeated with an additional pipe segment 11.

Figure 6:
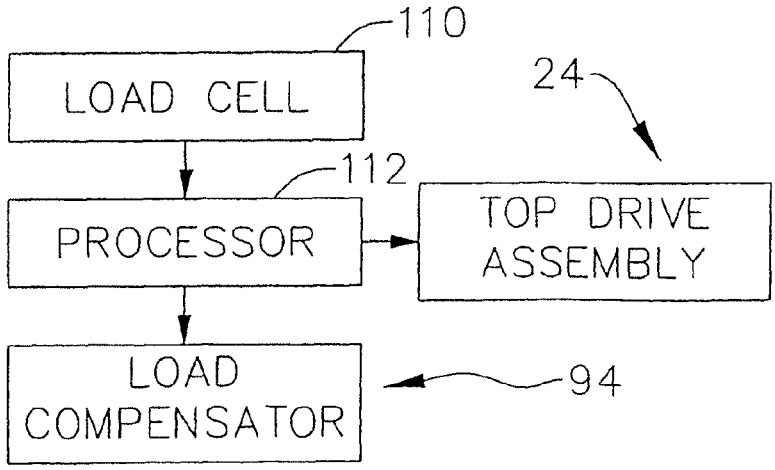
FIG. 6 is a block diagram of components included in one illustrative embodiment of the invention.

Referring to FIG. 6, there is shown a block diagram of components included in one illustrative embodiment of the pipe running tool 10. In this embodiment, the tool includes a conventional load cell 110 or other suitable load-measuring device mounted on the pipe running tool 10 in such a manner that it is in communication with the lower drive shaft 14 of the pipe running tool 10 to determine the load applied to the lower end of the pipe segment 11. The load cell 110 is operative to generate a signal representing the load sensed, which in one illustrative embodiment is transmitted to a processor 112. The processor 112 is programmed with a predetermined threshold load value, and compares the signal from the load cell 110 with that value. If the load exceeds the value, the processor then controls the load compensator 94 to draw upwardly a selected amount to relieve at least a portion of the load on the threads of the pipe segment 11. Once the load is at or below the threshold value, the processor 112 controls the top drive assembly 24 to rotate the pipe segment 11 and thereby threadedly engage the pipe segment 11 to the pipe string 34. While the top drive assembly 24 is actuated, the processor 112 continues to monitor the signals from the load cell 110 to ensure that the load on the pipe segment 11 does not exceed the threshold value.

Alternatively, the load on the pipe segment 11 may be controlled manually, with the load cell 110 indicating the load on the pipe segment 11 via a suitable gauge or other display, with a work person controlling the load compensator 94 and top drive assembly 24 accordingly.

Figure 7:
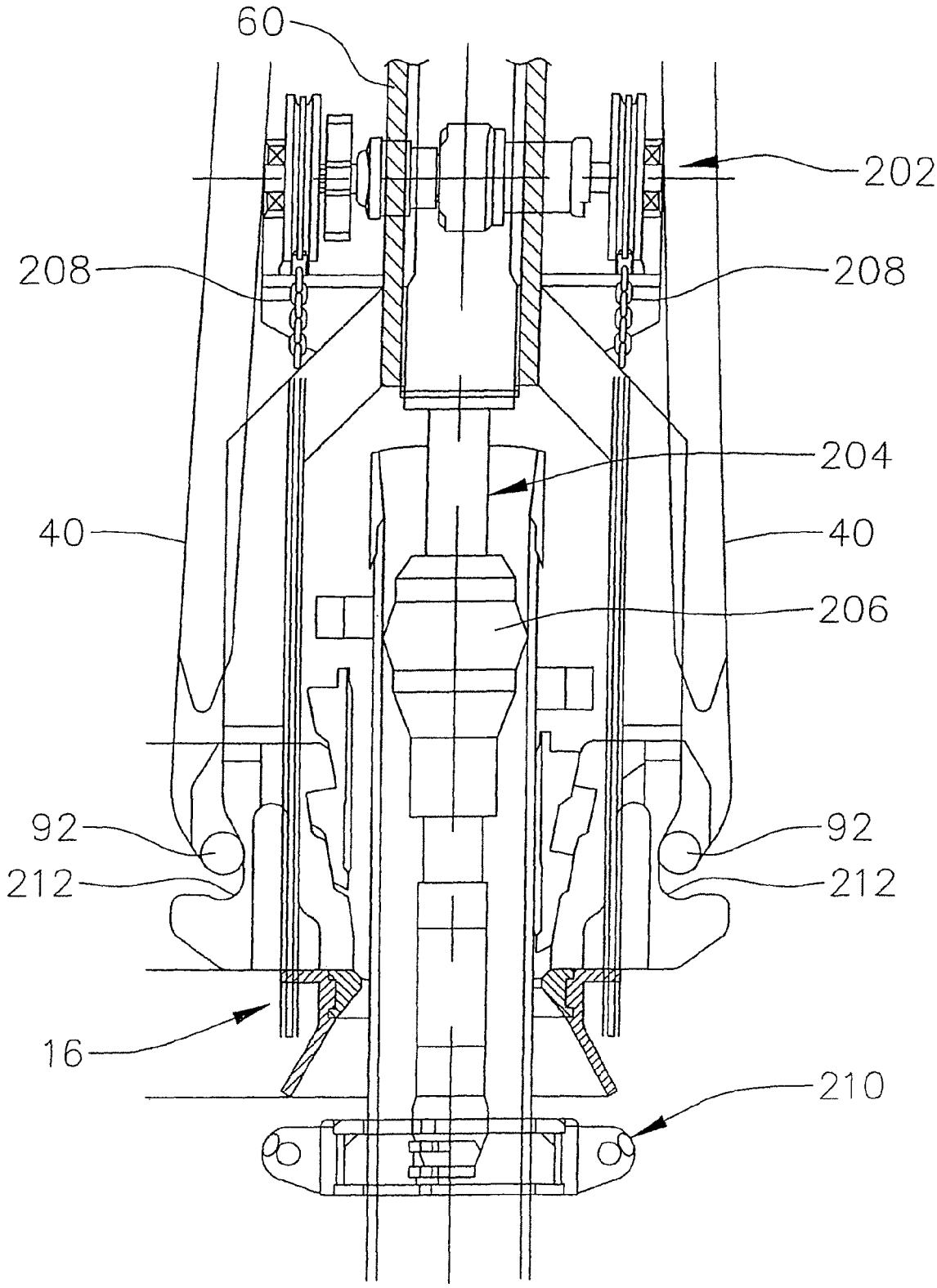
FIG. 7 is a side view of another illustrative embodiment of the invention.

Referring to FIG. 7, there is shown another preferred embodiment of the pipe running tool 200 of the present invention. The pipe running tool includes a hoisting mechanism 202 which is substantially the same as the hoisting mechanism 104 described above. A lower drive shaft 204 is provided and connects at its lower end to a conventional mud-filling device 206 which, as is known in the art, is used to fill a pipe segment 11, for example, a casing segment, with mud during the assembly process. In one illustrative embodiment, the mud-filling device is a device manufactured by Davies-Lynch Inc. of Texas.

The hoisting mechanism 202 supports a pair of chains 208 which engage a slip-type single joint elevator 210 at the lower end of the pipe running tool 200. As is known in the art, the single joint elevator is operative to releasably engage a pipe segment 11, with the hoisting mechanism 202 being operative to raise the single joint elevator and the pipe segment 11 upwardly and into the spider\elevator 74.

The tool 200 includes the links 40 which define the cylindrical lower ends 92 which are received in generally J-shaped cut-outs 212 formed in diametrically opposite sides of the spider\elevator 74.

From the foregoing, it will be apparent that the pipe running tool 10 efficiently utilizes an existing top drive assembly 24 to assemble a pipe string 11, for example, a casing or drill string, and does not rely on cumbersome casing tongs and other conventional devices. The pipe running tool 10 incorporates the spider\elevator 74, which not only carries pipe segments 11, but also imparts rotation to them to threadedly engage the pipe segments 11 to an existing pipe string 34. Thus, the pipe running tool 10 provides a device which grips and torques the pipe segment 11, and which also is capable of supporting the entire load of the pipe string 34 as it is lowered down into the well hole.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A system for coupling a pipe segment to a pipe string and introducing the pipe string into a borehole, comprising:

a top drive assembly including a drive shaft, the top drive assembly being operative to rotate the drive shaft; and a pipe running tool coupled to the drive shaft and rotatable by the drive shaft, wherein the pipe running tool comprises a pipe engaging portion having a plurality of slips for grippingly engaging the pipe segment sufficient to transmit a torque from the drive shaft to the pipe segment and sufficient to vertically support the weight of a string of pipe segments, and wherein the pipe running tool comprises a lower end connected to a mud-filling device.

2. The system of claim 1, further comprising a splined connection between the drive shaft and the pipe engaging portion, for transmitting rotation from the drive shaft to the pipe engaging portion.

3. The system of claim 1, wherein the pipe engaging portion comprises a powered elevator.

4. The system of claim 3, further comprising a torque frame coupled to the powered elevator.

5. The system of claim 1, wherein each slip comprises a generally planar front gripping surface.

6. The system of claim 5, wherein each slip further comprises a contoured rear surface.

7. The system of claim 6, wherein the pipe engaging portion comprises projecting guiding members that engage the slips and force the slips inwardly to engage the pipe segment.

8. The system of claim 1, further comprising a pipe segment carried by the pipe engaging portion.

9. The system of claim 1, further comprising a pipe string carried by the pipe engaging portion.

10. The system of claim 9, wherein the pipe string comprises a drill string comprising a drill bit at a lower end of the drill string.

11. The system of claim 9, wherein the pipe string comprises a casing string.

12. The system of claim 1, wherein the pipe running tool further comprises a load compensator coupled between the pipe engaging portion and the drive shaft of the top drive assembly.

13. The system of claim 12, wherein the load compensator is extendable and retractable to move the pipe engaging portion with respect to the drive shaft.

14. The system of claim 13, further comprising a measuring device in communication with the pipe running tool to measure a load applied to the pipe segment, and further comprising a processor in communication with the measuring device and with the load compensator, to operate the load compensator in response to the measurement.

15. The system of claim 14, wherein the pipe running tool further comprises a splined interface above the pipe engaging portion, for transmitting rotation from the drive shaft to the pipe engaging portion and for allowing extension and retraction of the load compensator.

16. The system of claim 1, wherein the mud-filling device is configured to contact an interior of the pipe segment.

17. A system for coupling a pipe segment to a pipe string and introducing the pipe string into a borehole, comprising:

a top drive assembly including a drive shaft, the top drive assembly being operative to rotate the drive shaft; and a pipe running tool coupled to the drive shaft and rotatable by the drive shaft, wherein the pipe running tool comprises a pipe engaging portion having a plurality of slips for grippingly engaging the pipe segment sufficient to transmit a torque from the drive shaft to the pipe segment and sufficient to vertically support the weight of a string of pipe segments, and wherein the pipe running tool comprises a load compensator coupled between the pipe engaging portion and the drive shaft of the top drive assembly, the load compensator being extendable and retractable to move the pipe engaging portion with respect to the drive shaft of the top drive assembly.

18. The system of claim 17, wherein each slip comprises a generally planar front gripping surface having gripping teeth for engaging the pipe segment.

19. The system of claim 17, further comprising a slip cone section which slidably receives the plurality of slips, and further comprising a slip cylinder connected to the plurality of slips such that movement of the slip cylinder causes movement of the slips.

20. The system of claim 17, wherein the slips of the pipe engaging portion are grippingly engaged with the pipe segment, and wherein the pipe segment is connected to a pipe string, and wherein a weight of the pipe running tool, the pipe segment, and the pipe string is directly supported by the drive shaft of the top drive assembly.

21. The system of claim 17, wherein the pipe running tool comprises a lower end connected to a mud-filling device.

22. The system of claim 17, further comprising a measuring device in communication with the pipe running tool to measure a load applied to the pipe segment, and further comprising a processor in communication with the measuring device and with the load compensator, to operate the load compensator in response to the measurement.

23. The system of claim 17, wherein the pipe running tool further comprises a splined interface above the pipe engaging portion, for transmitting rotation from the drive shaft to the pipe engaging portion and for allowing extension and retraction of the load compensator.

* * * * *